US012454431B2

(12) United States Patent
Mizutani

(10) Patent No.: US 12,454,431 B2
(45) Date of Patent: Oct. 28, 2025

(54) BASE PAPER ROLL SUPPLY DEVICE, BASE PAPER ROLL SUPPLY METHOD, AND DEVICE FOR MANUFACTURING CARDBOARD SHEET

(71) Applicant: MITSUBISHI HEAVY INDUSTRIES MACHINERY SYSTEMS, LTD., Hyogo (JP)

(72) Inventor: Hideki Mizutani, Hyogo (JP)

(73) Assignee: MITSUBISHI HEAVY INDUSTRIES MACHINERY SYSTEMS, LTD., Kobe (JP)

( * ) Notice: Subject to any disclaimer, the term of this patent is extended or adjusted under 35 U.S.C. 154(b) by 419 days.

(21) Appl. No.: 18/008,132

(22) PCT Filed: May 14, 2021

(86) PCT No.: PCT/JP2021/018358
§ 371 (c)(1),
(2) Date: Dec. 2, 2022

(87) PCT Pub. No.: WO2021/246135
PCT Pub. Date: Dec. 9, 2021

(65) Prior Publication Data

US 2023/0286766 A1 Sep. 14, 2023

(30) Foreign Application Priority Data

Jun. 5, 2020 (JP) ..... 2020-098428

(51) Int. Cl.
*B65H 19/12* (2006.01)

(52) U.S. Cl.
CPC ... *B65H 19/126* (2013.01); *B65H 2701/1762* (2013.01)

(58) Field of Classification Search
CPC ..... B65H 2701/1762; B31F 1/28
See application file for complete search history.

(56) References Cited

U.S. PATENT DOCUMENTS 3,282,764 A * 11/1966 Goettsch ..... B31F 1/2813 156/292
4,919,353 A 4/1990 Isowa et al.
(Continued)

FOREIGN PATENT DOCUMENTS

JP 2008247513 A 10/2008
JP 2012158430 A 8/2012
JP 5675394 B2 2/2015

OTHER PUBLICATIONS

International Search Report and Written Opinion of International Application No. PCT/JP2021/018358 mailed Jul. 13, 2021; 10pp.
(Continued)

*Primary Examiner* — William A. Rivera
(74) *Attorney, Agent, or Firm* — HAUPTMAN HAM, LLP

(57) ABSTRACT

A base paper roll supply device includes: a first stand rotatably supporting a rear-liner base paper roll and a rear-liner replacement base paper roll; a second stand rotatably supporting a core base paper roll and a core replacement base paper roll; and a third stand rotatably supporting a front-liner base paper roll and a front-liner replacement base paper roll. The first stand, the second stand, and the third stand are arranged in order along a supply direction in which the rear liner, the core, and the front liner are supplied. At the first stand, the rear-liner replacement base paper roll is arranged at an upstream side in the supply direction with respect to the rear-liner base paper roll, and at the third stand, the front-liner replacement base paper roll is arranged at a downstream side in the supply direction with respect to the front-liner base paper roll.

10 Claims, 7 Drawing Sheets

(56) References Cited

U.S. PATENT DOCUMENTS

| | | | | |
|---|---|---|---|---|
| 12,080,194 | B1 * | 9/2024 | Drummond | B31F 5/04 |
| 2003/0080235 | A1 * | 5/2003 | Sato | B65H 19/1852 242/555.6 |
| 2005/0016690 | A1 * | 1/2005 | Gmeiner | B29C 66/438 156/73.1 |
| 2008/0251211 | A1 * | 10/2008 | Akiyama | B31F 1/2813 156/472 |
| 2015/0007942 | A1 * | 1/2015 | Hung | B31F 1/285 156/378 |
| 2015/0360436 | A1 * | 12/2015 | Ohira | B31F 1/2818 156/354 |
| 2019/0018629 | A1 * | 1/2019 | Seay | G06F 3/1204 |
| 2020/0118262 | A1 * | 4/2020 | Takemoto | B31F 1/2813 |
| 2024/0343014 | A1 * | 10/2024 | Sakamoto | B31F 1/2831 |

OTHER PUBLICATIONS

Extended European Search Report for European Application No. 21817178.3 dated Aug. 29, 2024; 8pp.

Office Action for Japanese Application No. 2020-098428 mailed Aug. 8, 2023; 6pp.

* cited by examiner

BASE PAPER ROLL SUPPLY DEVICE, BASE PAPER ROLL SUPPLY METHOD, AND DEVICE FOR MANUFACTURING CARDBOARD SHEET

RELATED APPLICATIONS

The present application is a National Phase of International Application Number PCT/JP2021/018358, filed May 14, 2021, and claims priority of Japanese Application Number 2020-098428 filed Jun. 5, 2020.

TECHNICAL FIELD

The present disclosure relates to paper roll handling equipment for supplying base paper, a paper roll handling method, and a cardboard sheet manufacturing apparatus provided with the paper roll handling equipment.

BACKGROUND ART

A corrugating machine as a cardboard sheet manufacturing apparatus includes a single facer and a double facer. The single facer processes a medium into a corrugated shape and bonds a top liner to the corrugated medium to form a single-faced cardboard sheet. The double facer bonds a bottom liner to the single-faced cardboard sheet to form a double-faced cardboard sheet. The continuous double-faced cardboard sheet manufactured by the double facer is cut to a predetermined width by a slitter scorer and cut to a predetermined length by a cutoff device, so that cardboard sheets are manufactured.

Further, the corrugating machine has paper roll handling equipment for supplying base paper. The paper roll handling equipment has a plurality of mill roll stands. The mill roll stand has a splicer (a paper splicing device). The plurality of mill roll stands rotatably support base paper rolls such as a bottom liner, a top liner, and a medium. The mill roll stand has two arms. One arm rotatably supports the base paper roll from which the base paper is being supplied. The other arm rotatably supports the base paper roll to be used next. The splicer replaces the base paper roll by splicing the base paper to be used next to the base paper which is being supplied, so that the base paper can be continuously supplied.

For paper splicing using such a splicer, paper splicing preparation work is performed by a worker. That is, the worker sets a base paper tip of the base paper roll to be used next on the splicer, and attaches a double-sided tape to the base paper tip. Thereafter, the splicer automatically presses the tip of the base paper to be used next to the base paper which is being supplied, thereby pressure-bonding the tip of the base paper to be used next to the base paper which is being supplied by the double-sided tape, and cuts the base paper which is being supplied on the upstream side of the pressure-bonding position, so that the base paper to be used next is spliced to the base paper which is being supplied.

As a mill roll stand having such a splicer, for example, there is a device described in PTL 1 below.

CITATION LIST

Patent Literature

[PTL 1] Japanese Patent No. 5675394

SUMMARY OF INVENTION

Technical Problem

As described above, the paper splicing preparation work is performed by the worker. However, in a case where an order is frequently switched, the paper splicing preparation work is frequently performed in each of the plurality of mill roll stands. Therefore, there has been a demand to reduce the burden of the paper splicing preparation work by setting the base paper roll with the double-sided tape attached thereto in advance on the mill roll stand.

The present disclosure solves the problem described above, and has an object to provide paper roll handling equipment, a paper roll handling method, and a cardboard sheet manufacturing apparatus, in which it is possible to improve workability.

Solution to Problem

Paper roll handling equipment of the present disclosure for achieving the above object includes: a first mill roll stand that rotatably supports a paper roll for top liner and a paper roll for top liner replacement; a second mill roll stand that rotatably supports a paper roll for medium paper and a paper roll for medium paper replacement; and a third mill roll stand that rotatably supports a paper roll for bottom liner and a paper roll for bottom liner replacement, in which the first mill roll stand, the second mill roll stand, and the third mill roll stand are disposed in order along a supply direction of supplying a top liner, a medium, and a bottom liner, and in the first mill roll stand, the paper roll for top liner replacement is disposed on an upstream side in the supply direction with respect to the paper roll for top liner, and in the third mill roll stand, the paper roll for bottom liner replacement is disposed on a downstream side in the supply direction with respect to the paper roll for bottom liner.

Further, a paper roll handling method of the present disclosure includes a first mill roll stand that rotatably supports a paper roll for top liner and a paper roll for top liner replacement, a second mill roll stand that rotatably supports a paper roll for medium paper and a paper roll for medium replacement, and a third mill roll stand that rotatably supports a paper roll for bottom liner and a paper roll for bottom liner replacement, in which the first mill roll stand, the second mill roll stand, and the third mill roll stand are disposed in order along a supply direction of supplying a top liner, a medium, and a bottom liner, the method including: moving the paper roll for top liner replacement along the supply direction to supply it to a position adjacent to the paper roll for top liner; and moving the paper roll for bottom liner replacement along a direction opposite to the supply direction to supply it to a position adjacent to the paper roll for bottom liner.

Further, a cardboard sheet manufacturing apparatus of the present disclosure includes: the paper roll handling equipment described above; a single facer that manufactures a single-faced cardboard sheet by bonding the top liner to the corrugated medium; and a double facer that manufactures a cardboard sheet by bonding the bottom liner to the medium side of the single-faced cardboard sheet.

Advantageous Effects of Invention

According to the paper roll handling equipment, the paper roll handling method, and the cardboard sheet manufacturing apparatus of the present disclosure, it is possible to improve workability.

DESCRIPTION OF EMBODIMENTS

A preferred embodiment of the present disclosure will be described in detail below with reference to the drawings. The present disclosure is not limited by this embodiment, and in a case where there are a plurality of embodiments, configurations made by combining the respective embodiments are also included in the present disclosure. Further, components that can be easily assumed by those skilled in the art, components that are substantially the same as the components in the embodiment, and components in a so-called equivalent scope are also included in the components in the embodiment.

[Corrugating Machine]

Figure 1:
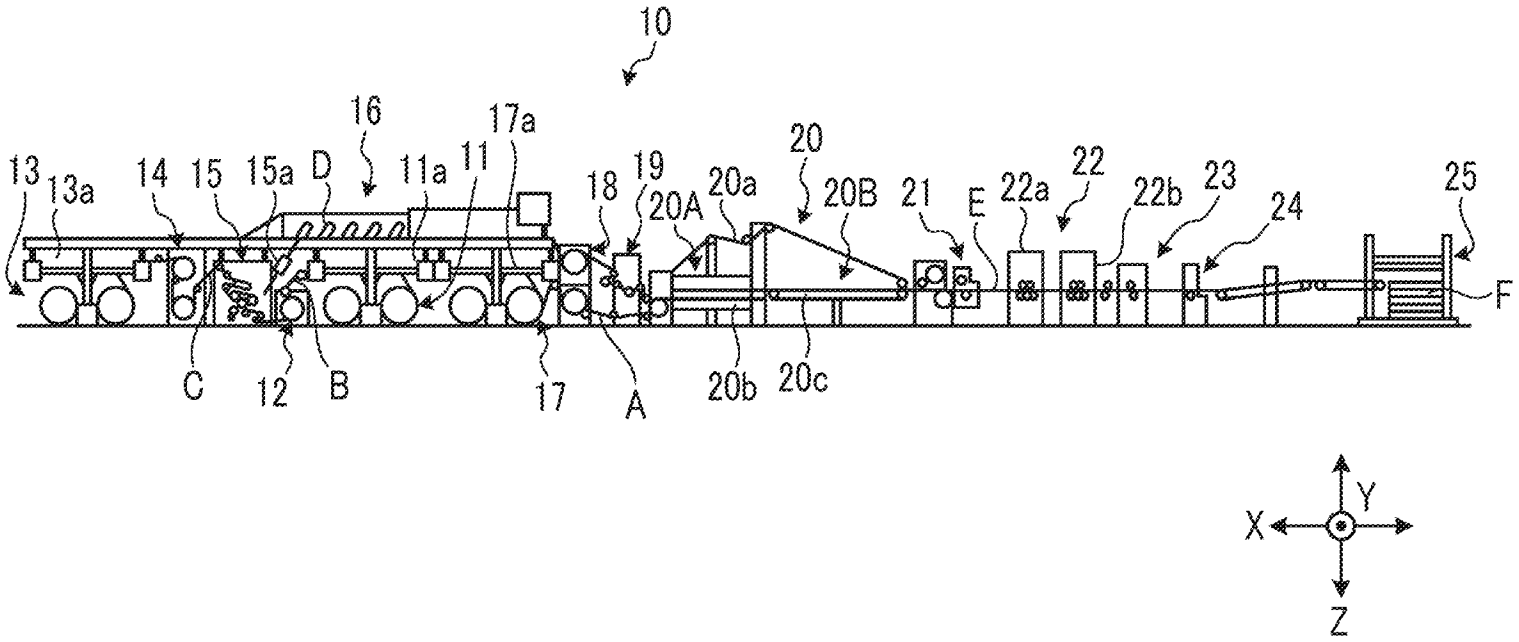
FIG. 1 is a schematic diagram showing a corrugating machine as a cardboard sheet manufacturing apparatus of the present embodiment.

FIG. 1 is a schematic diagram showing a corrugating machine as a cardboard sheet manufacturing apparatus of the present embodiment. In the following description, the longitudinal direction of the corrugating machine is set as an X direction, the horizontal direction orthogonal to the longitudinal direction (X direction) of the corrugating machine is set as a Y direction (a width direction of the cardboard sheet), and the vertical direction (a thickness direction of a cardboard sheet) orthogonal to the longitudinal direction (X direction) of the corrugating machine is set as a Z direction.

As shown in FIG. 1, a corrugating machine 10 as a cardboard sheet manufacturing apparatus is for manufacturing a single-faced cardboard sheet D by bonding a top liner C to a corrugated medium B, manufacturing a double-faced cardboard sheet E by bonding a bottom liner A to the medium B side of the manufactured single-faced cardboard sheet D, and manufacturing a plate-shaped double-faced cardboard sheet F by cutting the continuous double-faced cardboard sheet E to a predetermined length.

The corrugating machine 10 includes a mill roll stand 11 and a preheater 12 for the medium B, a mill roll stand 13 and a preheater 14 for the top liner C, a single facer 15, a bridge 16, a mill roll stand 17 and a preheater 18 for the bottom liner A, a glue machine 19, a double facer 20, a rotary shear 21, a slitter scorer 22, a cutoff 23, a defective sheet rejecting device 24, and a stacker 25.

In the mill roll stand 11, base paper rolls, in each of which the medium B is wound in a roll shape, are respectively mounted on both sides in the X direction, and a splicer 11*a* which performs paper splicing is provided on the upper side in the Z direction. When the remaining of the base paper roll on one side is a small amount, or at the time of order switching, paper splicing is performed on the base paper roll on the other side by the splicer 11*a*, so that the medium B can be continuously fed from the mill roll stand 11.

In the mill roll stand 13, base paper rolls, in each of which the top liner C is wound in a roll shape, are respectively mounted on both sides in the X direction, and a splicer 13*a* which performs paper splicing is provided on the upper side thereof in the X direction. When the remaining of the base paper roll on one side is a small amount, or at the time of order switching, paper splicing is performed on the base paper roll on the other side by the splicer 13*a*, so that the top liner C can be continuously fed from the mill roll stand 13.

The preheaters 12 and 14 preheat the medium B and the top liner C, respectively. The preheaters 12 and 14 have preheating rolls in which steam is supplied to the interior thereof, and transport the medium B and the top liner C, which are continuously fed from the mill roll stands 11 and 13, while heating them by the preheating rolls, so that the medium B and the top liner C are heated to a predetermined temperature.

The single facer 15 forms the single-faced cardboard sheet D by processing the medium B heated by the preheater 12 into a corrugated shape, then applying an adhesive to a top portion of each corrugation, and bonding the top liner C heated by the preheater 14 to the corrugated medium B. Further, a pickup conveyor 15*a* is provided at an outlet for the single-faced cardboard sheet D of the single facer 15. The pickup conveyor 15*a* is composed of a pair of endless belts and clamps the single-faced cardboard sheet D formed by the single facer 15 to transport it to the bridge 16. The bridge 16 temporarily retains the single-faced cardboard sheet D in order to absorb a difference in speed between the single facer 15 and the double facer 20.

In the mill roll stand 17, base paper rolls, in each of which the bottom liner A is wound in a roll shape, are respectively mounted on both sides in the X direction, and a splicer 17*a* which performs paper splicing is provided on the upper side thereof. When the remaining of the base paper roll on one side is a small amount, or at the time of order switching, paper splicing is performed on the base paper roll on the other side by the splicer 17*a*, so that the bottom liner A can be continuously fed from the mill roll stand 17.

The preheater 18 preheats each of the single-faced cardboard sheet D and the bottom liner A. The preheater 18 has a preheating roll in which steam is supplied to the interior thereof, and transports the single-faced cardboard sheet D and the bottom liner A, which is continuously fed from the mill roll stand 17, while heating them by the preheating roll, so that the single-faced cardboard sheet D and the bottom liner A are heated to a predetermined temperature.

The glue machine 19 has adhesive equipment. The single-faced cardboard sheet D heated by the preheating roll is guided into the glue machine 19 on the way, and when the single-faced cardboard sheet D passes between a rider roll and an adhesive applicator roll, an adhesive is applied to a top portion of each of the corrugations of the medium B. The single-faced cardboard sheet D with an adhesive applied thereto by the glue machine 19 is transferred to the double facer 20. Further, the bottom liner A heated by the preheating roll is also transferred to the double facer 20 through the glue machine 19.

The double facer 20 is divided into a heating section 20A and a cooling section 20B along a traveling line of the single-faced cardboard sheet D and the bottom liner A. The single-faced cardboard sheet D with an adhesive applied thereto by the glue machine 19 is carried in between a pressurizing belt 20*a* and a hot plate 20*b* in the heating section 20A, and the bottom liner A is carried in between the pressurizing belt 20*a* and the hot plate 20*b* so as to overlap the medium B side of the single-faced cardboard sheet D. The single-faced cardboard sheet D and the bottom liner A are carried in between the pressurizing belt 20*a* and the hot plate 20*b*, and then integrated in a state of being overlapped up and down, and transferred toward the cooling section 20B. During this transfer, the single-faced cardboard sheet D and the bottom liner A are heated while being pressurized, so that they are bonded to each other to form the continuous double-faced cardboard sheet E. The double-faced cardboard sheet E is naturally cooled in the cooling section 20B when being clamped and transported by the pressurizing belt 20*a* and a transport belt 20*c*, and transferred to the rotary shear 21.

The rotary shear 21 cuts over the entire width or partially the double-faced cardboard sheet E in the width direction (the Y direction) before the bonding is stabilized in an operation initial stage. The slitter scorer 22 cuts the wide double-faced cardboard sheet E along the longitudinal direction (the X direction) of the corrugating machine 10 so as to have a predetermined width, and forms creasing lines extending in the longitudinal direction of the corrugating machine 10. The slitter scorer 22 is composed of a first slitter scorer unit 22*a* and a second slitter scorer unit 22*b* having substantially the same structure, which are arranged along the longitudinal direction of the corrugating machine 10 of the double-faced cardboard sheet E. Each of the first slitter scorer unit 22*a* and the second slitter scorer unit 22*b* has a plurality of sets of upper creasing line rolls and lower creasing line rolls, which are disposed to face each other with the double-faced cardboard sheet E interposed therebetween, in the width direction, and has a plurality of sets of slitter knives, which are disposed on the lower side of the double-faced cardboard sheet E, in the width direction.

The cutoff 23 cuts the double-faced cardboard sheet E cut in the longitudinal direction of the corrugating machine 10 by the slitter scorer 22, along the width direction (the Y direction) to form the plate-shaped double-faced cardboard sheet F having a predetermined length. The defective sheet rejecting device 24 rejects the double-faced cardboard sheet F determined to be a defective sheet by a defect detection device from a transport line. The stacker 25 stacks the non-defective double-faced cardboard sheets F and discharges them as products to the outside of the machine.

[Paper Roll Handling Equipment]

Figure 2:
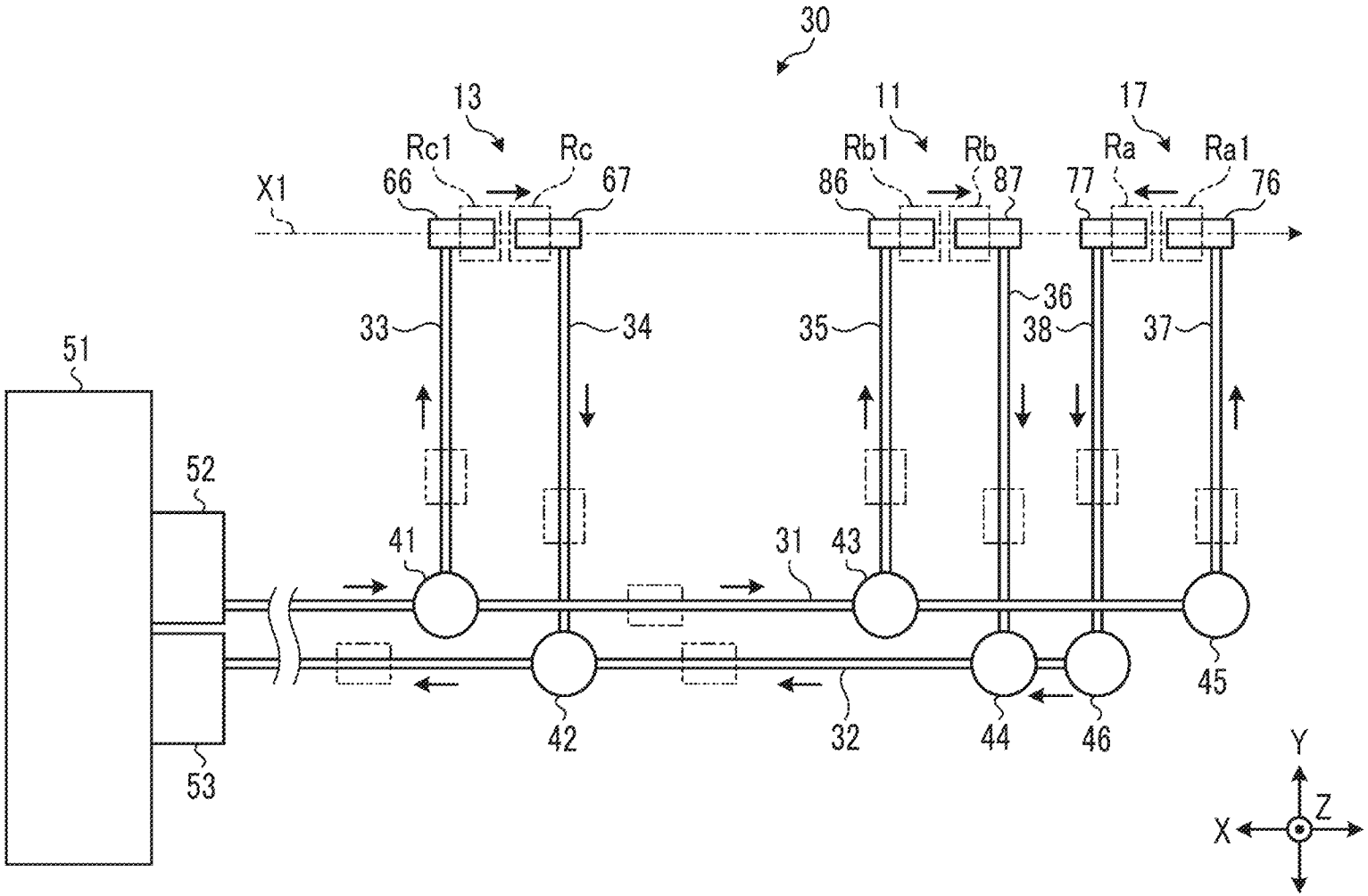
FIG. 2 is a schematic plan view showing paper roll handling equipment of the present embodiment.

FIG. 2 is a schematic plan view showing the paper roll handling equipment of the present embodiment.

As shown in FIG. 2, paper roll handling equipment 30 includes the mill roll stand (a second mill roll stand) 11 for the medium B, the mill roll stand (a first mill roll stand) 13 for the top liner C, and the mill roll stand (a third mill roll stand) 17 for the bottom liner A. The mill roll stands 11, 13, and 17 are disposed in order along a supply direction X1 of supplying the medium B, the top liner C, and the bottom liner A.

The mill roll stand 11 rotatably supports a paper roll for medium paper Rb and a paper roll for medium paper replacement Rb1. The mill roll stand 13 rotatably supports a paper roll for top liner Rc and a paper roll for top liner replacement Rc1. The mill roll stand 17 rotatably supports a paper roll for bottom liner Ra and a paper roll for bottom liner replacement Rat. Here, the paper roll for medium paper Rb, the paper roll for top liner Rc, and the paper roll for bottom liner Ra respectively represent the medium B, the top liner C, and the bottom liner A, which are being supplied. Further, the paper roll for medium paper replacement Rb1, the paper roll for top liner replacement Rc1, and the paper roll for bottom liner replacement Ra1 represent the medium B, the top liner C, and the bottom liner A to be used next.

In the mill roll stand 11, the paper roll for medium paper replacement Rb1 is disposed on the upstream side in the supply direction X1 with respect to the paper roll for medium paper Rb. In the mill roll stand 13, the paper roll for top liner replacement Rc1 is disposed on the upstream side in the supply direction X1 with respect to the paper roll for top liner Rc. In the mill roll stand 17, the paper roll for bottom liner replacement Ra1 is disposed on the downstream side in the supply direction X1 with respect to the paper roll for bottom liner Ra.

The paper roll handling equipment 30 includes a carry-in line 31 and a carry-out line 32 provided on one side (the lower side in FIG. 2) in the direction intersecting the supply direction X1. The carry-in line 31 and the carry-out line 32 are disposed in parallel with each other at a predetermined interval, and are disposed in parallel with the supply direction X1. Further, the paper roll handling equipment 30 includes a paper roll carry-in line for top liner 33 and a paper roll carry-out line for top liner 34 provided on one side (the lower side in FIG. 2) in the direction intersecting the supply direction X1. The paper roll handling equipment 30 includes a paper roll carry-in line for medium paper 35 and a paper roll carry-out line for medium paper 36 provided on one side (the lower side in FIG. 2) in the direction intersecting the supply direction X1. The paper roll handling equipment 30 includes a paper roll carry-in line for bottom liner 37 and a paper roll carry-out line for bottom liner 38 provided on one side (the lower side in FIG. 2) in the direction intersecting the supply direction X1.

The carry-in line 31 and the carry-out line 32, and each of the carry-in lines 33, 35, and 37 and each of the carry-out lines 34, 36, and 38 are disposed along the directions orthogonal to each other. One end portion of the paper roll carry-in line for top liner 33 is connected to the carry-in line 31 through a turntable 41, and the other end portion is connected to the mill roll stand 13. One end portion of the paper roll carry-out line for top liner 34 is connected to the carry-out line 32 through a turntable 42, and the other end portion is connected to the mill roll stand 13. One end portion of the paper roll carry-in line for medium paper 35 is connected to the carry-in line 31 through a turntable 43, and the other end portion is connected to the mill roll stand 11. One end portion of the paper roll carry-out line for medium paper 36 is connected to the carry-out line 32 through a turntable 44, and the other end portion is connected to the mill roll stand 11. One end portion of the paper roll carry-in line for bottom liner 37 is connected to the carry-in line 31 through a turntable 45, and the other end portion is connected to the mill roll stand 17. One end portion of the paper roll carry-out line for bottom liner 38 is connected to the carry-out line 32 through a turntable 46, and the other end portion is connected to the mill roll stand 17.

The paper roll handling equipment 30 includes a paper roll stock area 51, a splice preparation unit 52, and a remaining base paper roll collation unit 53. In the paper roll stock area 51, the splice preparation unit 52 and the remaining base paper roll collation unit 53 are disposed adjacent to each other. The splice preparation unit 52 is disposed on the upstream side of the carry-in line 31 in a base paper roll transfer direction. The remaining base paper roll collation unit 53 is disposed on the downstream side of the carry-out line 32 in the base paper roll transfer direction. The paper roll stock area 51 stores a large number of types of paper rolls for top liner, paper rolls for medium paper, and paper rolls for bottom liner, and carries out necessary paper roll for top liner, paper roll for medium paper, and paper roll for bottom liner. The splice preparation unit 52 is for attaching double-sided tapes (adhesive parts) to the tips of the top liner C, the medium B paper, and the bottom liner A in the paper roll for top liner, the paper roll for medium paper, and the paper roll for bottom liner, as paper splicing preparation work, and the work of the splice preparation unit 52 may be automatic or may be manual by a worker. The remaining base paper roll collation unit 53 collates the paper roll for medium paper, the paper roll for top liner, and the paper roll for bottom liner returned from the mill roll stands 11, 13, and 17.

[Mill Roll Stand for Top Liner]

Figure 3:
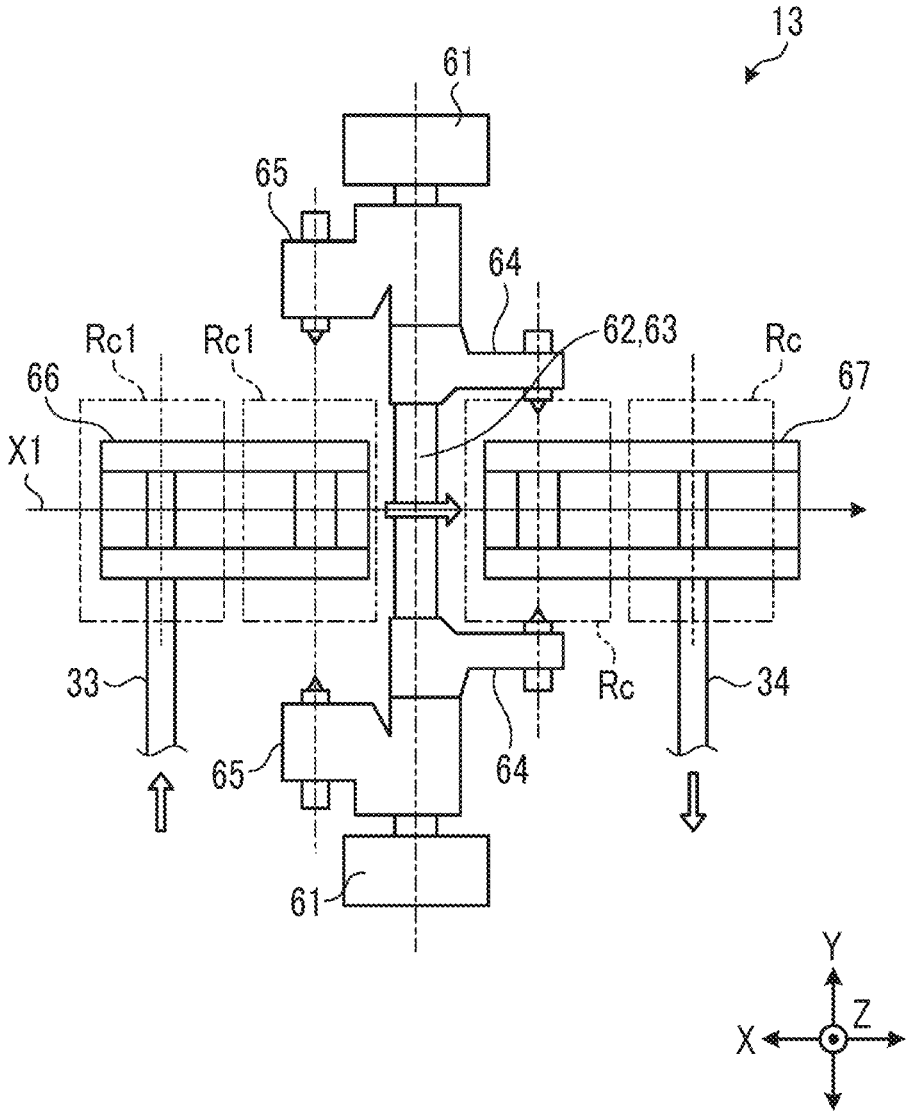
FIG. 3 is a plan view showing a mill roll stand for a top liner.
Figure 4:
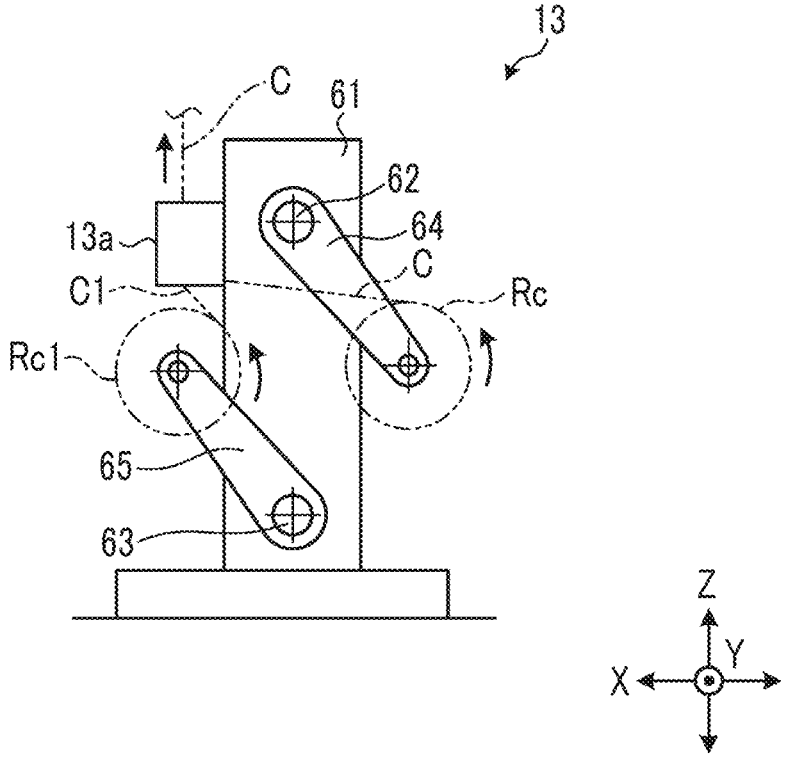
FIG. 4 is a front view showing the mill roll stand for a top liner.

FIG. 3 is a plan view showing the mill roll stand for the top liner, and FIG. 4 is a front view showing the mill roll stand for the top liner.

As shown in FIGS. 3 and 4, the mill roll stand 13 for the top liner includes a pair of support bases 61, an upper support shaft 62, a lower support shaft 63, an upper support arm 64, a lower support arm 65, a carry-in conveyor 66, a carry-out conveyor 67, and the splicer 13*a*.

The pair of support bases 61 are disposed at a predetermined interval on both sides in the supply direction X1. The upper support shaft 62 and the lower support shaft 63 are disposed along the horizontal direction orthogonal to the supply direction X1 and at a predetermined interval in an up-down direction. End portions in an axial direction of each of the upper support shaft 62 and the lower support shaft 63 are rotatably supported by the pair of support bases 61. The upper support shaft 62 and the lower support shaft 63 can be rotated by a drive device (not shown). The upper support arms 64 are disposed on both sides with the supply direction X1 interposed therebetween. One end portion in the longitudinal direction of the upper support arm 64 is connected to the upper support shaft 62, and a chuck is provided at the other end portion thereof. The lower support arms 65 are disposed on both sides with the supply direction X1 interposed therebetween. One end portion in the longitudinal direction of the lower support arm 65 is connected to the lower support shaft 63, and a chuck is provided at the other end portion thereof. The upper support arm 64 and the lower support arm 65 can be moved in the axial direction of the upper support shaft 62 and the lower support shaft 63 by a movement unit (not shown).

The carry-in conveyor 66 is disposed on the paper roll carry-in line for top liner 33 side with respect to the upper support shaft 62 and the lower support shaft 63. The carry-in conveyor 66 is connected to one end portion of the paper roll carry-in line for top liner 33. The carry-out conveyor 67 is disposed on the paper roll carry-out line for top liner 34 side. The carry-out conveyor 67 is connected to one end portion of the paper roll carry-out line for top liner 34. The splicer 13*a* is disposed on the carry-in conveyor 66 side with respect to the upper support shaft 62 and the lower support shaft 63. Although not shown, the splicer 13*a* has a pair of guide rolls, a pair of knives, and a pair of pressure-bonding bars.

The upper support arm 64 and the lower support arm 65 can rotatably support the paper roll for top liner Rc or the paper roll for top liner replacement Rc1. In FIGS. 3 and 4, the position where the upper support arm 64 supports the paper roll for top liner Rc is an operation position where the top liner C is sent out. The position where the lower support arm 65 supports the paper roll for top liner replacement Rc1 is a paper splicing position. Further, the position where the paper roll for top liner replacement Rc1 is placed on the carry-in conveyor 66 adjacent to the paper splicing position is a standby position. On the other hand, the position where the paper roll for top liner Rc is placed on the carry-out conveyor 67 adjacent to the operation position is a discharge position.

The paper roll for top liner replacement Rc1 is supplied from the paper roll carry-in line for top liner 33 to the standby position on the carry-in conveyor 66. When the upper support arm 64 supports the paper roll for top liner Rc at the operation position, the paper roll for top liner replacement Rc1 is transported to the position where it can be supported by the lower support arm 65 by the carry-in conveyor 66. The lower support arm 65 supports the paper roll for top liner replacement Rc1 and moves to the paper splicing position.

When it is time to replace the paper roll for top liner Rc, the splicer 13*a* is operated to perform paper splicing. When the paper splicing is completed, the upper support arm 64 places the supported paper roll for top liner Rc on the carry-out conveyor 67. The lower support arm 65 moves the supported paper roll for top liner replacement Rc1 to the operation position, and the paper roll for top liner replacement Rc1 is used as the paper roll for top liner Rc. The used paper roll for top liner Rc is moved to the carry-out position by the carry-out conveyor 67, and is carried out by the paper roll carry-out line for top liner 34. On the other hand, the upper support arm 64 supports the paper roll for top liner replacement Rc1 and moves to the paper splicing position.

That is, the mill roll stand 13 can move the paper roll for top liner Rc and the paper roll for top liner replacement Rc1 toward the supply direction X1 by operating the carry-in conveyor 66, the upper support arm 64, the lower support arm 65, and the carry-out conveyor 67. The mill roll stand 13 can send out the top liner C toward the direction opposite to the supply direction X1 by rotating the paper roll for top liner Rc and the paper roll for top liner replacement Rc1 in the same counterclockwise direction.

[Mill Roll Stand for Bottom Liner]

Figure 5:
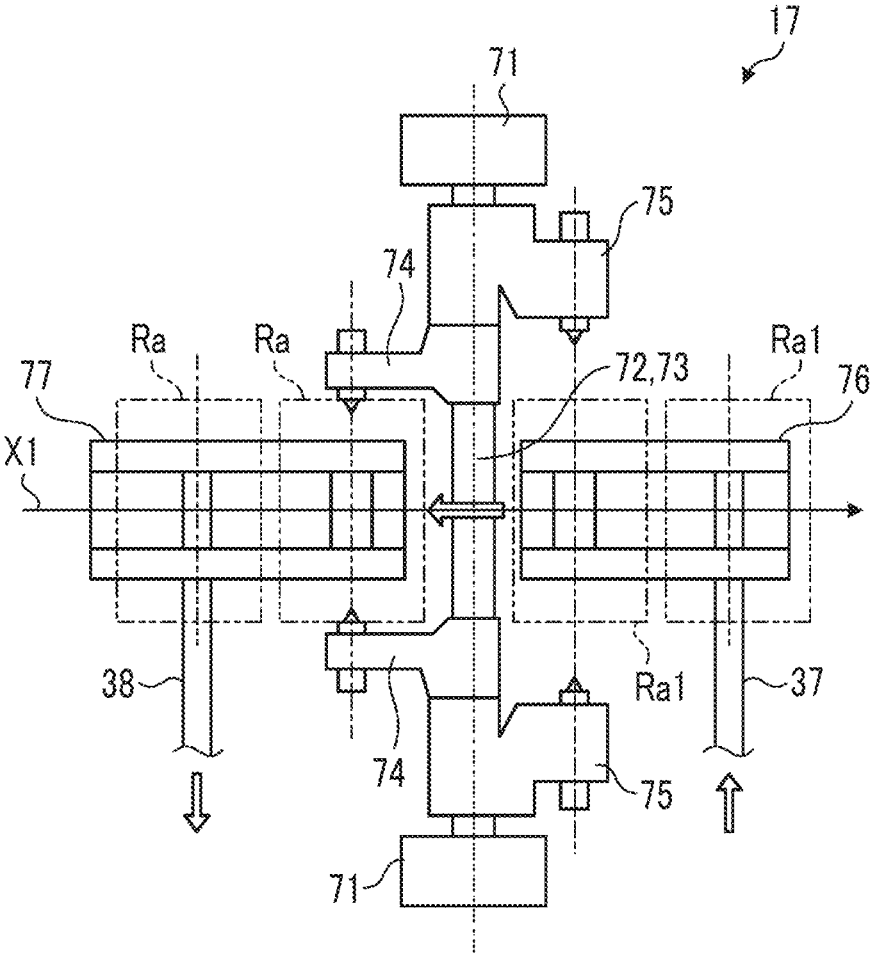
FIG. 5 is a plan view showing a mill roll stand for a bottom liner.
Figure 6:
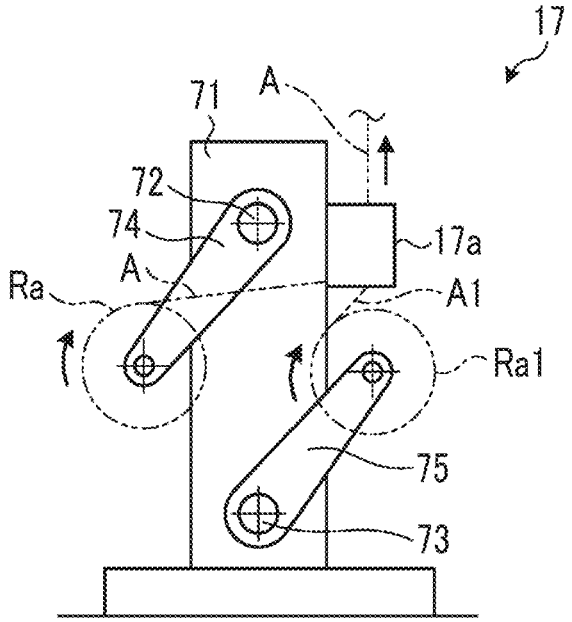
FIG. 6 is a front view showing the mill roll stand for a bottom liner.

FIG. 5 is a plan view showing the mill roll stand for the bottom liner, and FIG. 6 is a front view showing the mill roll stand for the bottom liner.

As shown in FIGS. 5 and 6, the mill roll stand 17 for the bottom liner includes a pair of support bases 71, an upper support shaft 72, a lower support shaft 73, an upper support arm 74, a lower support arm 75, a carry-in conveyor 76, a carry-out conveyor 77, and the splicer 17*a*.

The pair of support bases 71 are disposed at a predetermined interval on both sides in the supply direction X1. The upper support shaft 72 and the lower support shaft 73 are disposed along the horizontal direction orthogonal to the supply direction X1 and at a predetermined interval in the up-down direction. End portions in the axial direction of each of the upper support shaft 72 and the lower support shaft 73 are rotatably supported by the pair of support bases 71. The upper support shaft 72 and the lower support shaft 73 can be rotated by a drive device (not shown). The upper support arms 74 are disposed on both sides with the supply direction X1 interposed therebetween. One end portion in the longitudinal direction of the upper support arm 74 is connected to the upper support shaft 72, and a chuck is provided at the other end portion thereof. The lower support arms 75 are disposed on both sides with the supply direction X1 interposed therebetween. One end portion in the longitudinal direction of the lower support arm 75 is connected to the lower support shaft 73, and a chuck is provided at the other end portion thereof. The upper support arm 74 and the lower support arm 75 can be moved in the axial direction of the upper support shaft 72 and the lower support shaft 73 by a movement unit (not shown).

The carry-in conveyor 76 is disposed on the paper roll carry-in line for bottom liner 37 side with respect to the upper support shaft 72 and the lower support shaft 73. The carry-in conveyor 76 is connected to one end portion of the paper roll carry-in line for bottom liner 37. The carry-out conveyor 77 is disposed on the paper roll carry-out line for bottom liner 38 side. The carry-out conveyor 77 is connected to one end portion of the paper roll carry-out line for bottom liner 38. The splicer 17*a* is disposed on the carry-in conveyor 76 side with respect to the upper support shaft 72 and the lower support shaft 73. Although not shown, the splicer 17*a* has a pair of guide rolls, a pair of knives, and a pair of pressure-bonding bars.

The upper support arm 74 and the lower support arm 75 can rotatably support the paper roll for bottom liner Ra or the paper roll for bottom liner replacement Ra1. In FIGS. 5 and 6, the position where the upper support arm 74 supports the paper roll for bottom liner Ra is an operation position where the bottom liner A is sent out. The position where the lower support arm 75 supports the paper roll for bottom liner replacement Ra1 is a paper splicing position. Further, the position where the paper roll for bottom liner replacement Ra1 is placed on the carry-in conveyor 76 adjacent to the paper splicing position is a standby position. On the other hand, the position where the paper roll for bottom liner Ra is placed on the carry-out conveyor 77 adjacent to the operation position is a discharge position.

The paper roll for bottom liner replacement Ra1 is supplied from the paper roll carry-in line for bottom liner 37 to the standby position on the carry-in conveyor 76. When the upper support arm 74 supports the paper roll for bottom liner Ra at the operation position, the paper roll for bottom liner replacement Ra1 is transported to the position where it can be supported by the lower support arm 75 by the carry-in conveyor 76. The lower support arm 75 supports the paper roll for bottom liner replacement Ra1 and moves to the paper splicing position.

When it is time to replace the paper roll for bottom liner Ra, the splicer 17*a* is operated to perform paper splicing. When the paper splicing is completed, the upper support arm 74 places the supported paper roll for bottom liner Ra on the carry-out conveyor 77. The lower support arm 75 moves the supported paper roll for bottom liner replacement Ra1 to the operation position, and the paper roll for bottom liner replacement Ra1 is used as the paper roll for bottom liner Ra. The used paper roll for bottom liner Ra is moved to the carry-out position by the carry-out conveyor 77, and is carried out by the paper roll carry-out line for bottom liner 34. On the other hand, the upper support arm 74 supports the paper roll for bottom liner replacement Ra1 and moves to the paper splicing position.

That is, the mill roll stand 17 can move the paper roll for bottom liner Ra and the paper roll for bottom liner replacement Ra1 toward the direction opposite to the supply direction X1 by operating the carry-in conveyor 76, the upper support arm 74, the lower support arm 75, and the carry-out conveyor 77. The mill roll stand 17 can send out the bottom liner A toward the supply direction X1 by rotating the paper roll for bottom liner Ra and the paper roll for bottom liner replacement Ra1 in the same clockwise direction.

The mill roll stand 11 for the medium is the same as the mill roll stand 13 for the top liner, and the description thereof will be omitted. That is, the mill roll stand 11 can move the paper roll for medium paper Rb and the paper roll for medium paper replacement Rb1 toward the supply direction X1. The mill roll stand 11 can send out the medium B toward the direction opposite to the supply direction X1 by rotating the paper roll for medium paper Rb and the paper roll for medium paper replacement Rb1 in the same counterclockwise direction. However, the mill roll stand 11 for the medium may be configured like the mill roll stand 17 for the bottom liner. That is, the medium B may be able to be sent out toward the supply direction X1 by making the paper roll for medium paper Rb and the paper roll for medium paper replacement Rb1 movable toward the direction opposite to the supply direction X1 and rotating the paper roll for medium paper Rb and the paper roll for medium paper replacement Rb1 in the same clockwise direction.

[Paper Roll Handling Method]

In the paper roll handling method of the present embodiment, the paper roll for top liner replacement Rc1 is moved along the supply direction X1 to be supplied to the position (the standby position or the paper splicing position) adjacent to the paper roll for top liner Rc, and the paper roll for bottom liner replacement Ra1 is moved along the direction opposite to the supply direction X1 to be supplied to the position (the standby position or the paper splicing position) adjacent to the paper roll for bottom liner Ra.

As shown in FIG. 2, in the paper roll stock area 51, the paper roll for top liner, the paper roll for medium paper, and the paper roll for bottom liner necessary for the manufacture of a cardboard sheet are selected and transported to the splice preparation unit 52. In the splice preparation unit 52, splice preparation of attaching double-sided tapes to the tips of the outer surfaces of the top liner C, the medium B paper, and the bottom liner A in the paper roll for top liner, the paper roll for medium paper, and the paper roll for bottom liner is performed. The base paper rolls subjected to the splice preparation are sent to the carry-in line 31 as the paper roll for top liner replacement Rc1, the paper roll for medium paper replacement Rb1, and the paper roll for bottom liner replacement Ra1. In this case, attaching the double-sided tapes to the outer surfaces of the paper roll for top liner, the paper roll for medium paper, and the paper roll for bottom liner in the splice preparation in the splice preparation unit 52 is for facilitating attaching work by a worker. Further, this is also because, in a case where in the splice preparation unit 52, it is required to peel off the peeling surface of the double-sided tape and then send the paper roll for top liner, the paper roll for medium paper, and the paper roll for bottom liner to the carry-in line 31, if the double-sided tape is attached to the inner surface, the tips of the top liner C, the medium B paper, and the bottom liner A are attached to each base paper roll.

In the mill roll stand 13 for the top liner, the paper roll for top liner replacement Rc1 is supplied from the paper roll carry-in line for top liner 33 to the standby position on the carry-in conveyor 66, and moved in the supply direction X1 by the carry-in conveyor 66 to be moved to the paper splicing position where it is supported by the lower support arm 65 (refer to FIG. 4). When the paper splicing is completed by the splicer 13*a* (refer to FIG. 4), the paper roll for top liner Rc is released from the support by the upper support arm 64, moved to the carry-out position by the carry-out conveyor 67, and carried out by the paper roll carry-out line for top liner 34. Then, the paper roll for top liner replacement Rc1 supported by the lower support arm 65 is moved to the operation position and used as the paper roll for top liner Rc.

In the mill roll stand 11 for the medium, the paper roll for medium paper replacement Rb1 is supplied from the paper roll carry-in line for medium paper 35 to the standby position on the carry-in conveyor 86, and moved in the supply direction X1 by the carry-in conveyor 86 to be moved to the paper splicing position where it is supported by the lower support arm (not shown). When the paper splicing is completed by the splicer 11*a* (refer to FIG. 1), the paper roll for medium paper Rb is released from the support by the upper support arm (not shown), moved to the carry-out position by the carry-out conveyor 87, and carried out by the paper roll carry-out line for medium paper 36. Then, the paper roll for medium paper replacement Rb1 supported by the lower support arm is moved to the operation position and used as the paper roll for medium paper Rb.

In the mill roll stand 17 for the bottom liner, the paper roll for bottom liner replacement Rat is supplied from the paper roll carry-in line for bottom liner 37 to the standby position on the carry-in conveyor 76, and moved in the direction opposite to the supply direction X1 by the carry-in conveyor 76 to be moved to the paper splicing position where it is supported by the lower support arm 75 (refer to FIG. 6). When the paper splicing is completed by the splicer 17*a* (refer to FIG. 5), the paper roll for bottom liner Ra is released from the support by the upper support arm 74 (refer to FIG. 6), moved to the carry-out position by the carry-out conveyor 77, and carried out by the paper roll carry-out line for bottom liner 38. Then, the paper roll for bottom liner replacement Rat supported by the lower support arm is moved to the operation position and used as the paper roll for bottom liner Ra.

Figure 7:
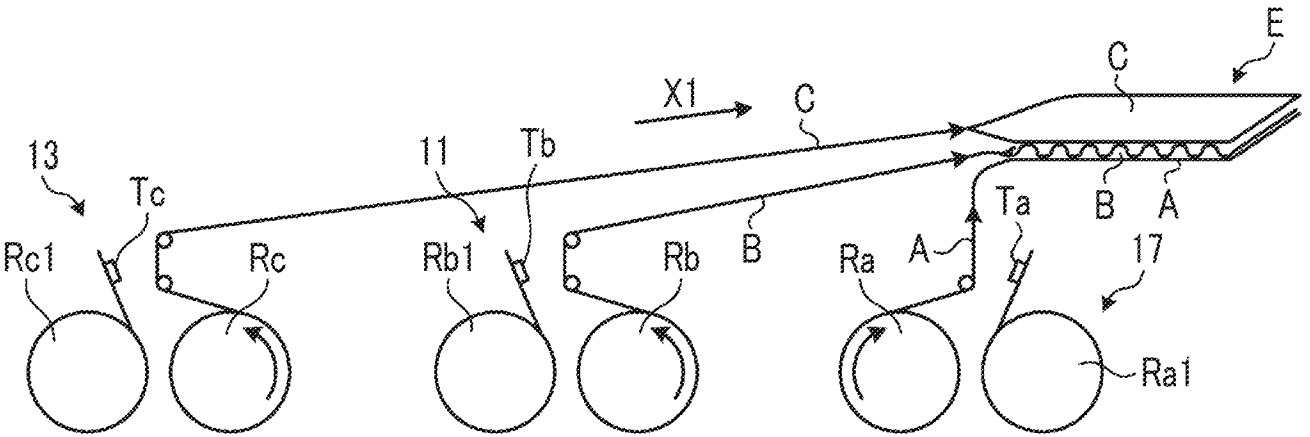
FIG. 7 is a schematic diagram showing disposition of mill roll stands and supply paths for a top liner, a medium, and a bottom liner.

FIG. 7 is a schematic diagram showing the disposition of the mill roll stands and the supply paths for the top liner, the medium, and the bottom liner.

As shown in FIGS. 2 and 7, the mill roll stand 13 for the top liner C, the mill roll stand 11 for the medium B, and the mill roll stand 17 for the bottom liner A are disposed in order along the supply direction X1. The top liner C, the medium B, and the bottom liner A are adhered to each other, so that the continuous double-faced cardboard sheet E is manufactured. At this time, the continuous double-faced cardboard sheet E is transported in a state where the top liner C is adhered to the upper surface side of the medium B and the bottom liner A is adhered to the lower surface side of the medium B. On the other hand, mainly, for the aesthetics of the double-faced cardboard sheet that is manufactured, the top liner C is adhered in the single facer 15 such that the inner side of the paper roll for top liner Rc becomes the outer surface in the double-faced cardboard sheet E, that is, the inner surface of the paper roll for top liner Rc is on the side opposite to the adhered surface to the medium B. Further, the bottom liner A is adhered in the double facer 20 such that the inner surface of the paper roll for bottom liner Ra becomes the outer surface in the double-faced cardboard sheet E, that is, the inner surface of the paper roll for bottom liner Ra is on the side opposite to the adhered surface to the medium B. Since the medium B is sandwiched between and adhered to the top liner C and the bottom liner A, it is not necessary to consider the directions of the inner surface and the outer surface of the paper roll for medium paper Rb.

As described above, in the splice preparation unit 52, splice preparation of attaching the double-sided tapes to the tips of the outer surfaces of the top liner C, the medium B, and the bottom liner A in the paper roll for top liner, the paper roll for medium paper, and the paper roll for bottom liner is performed. In this case, as shown in FIG. 7, double-sided tapes Tc, Tb, and Ta are respectively attached to the tips of the outer surfaces of the paper roll for top liner Rc1, the paper roll for medium paper Rb1, and the paper roll for bottom liner Rat.

The paper roll for top liner Rc1, the paper roll for medium paper Rb1, and the paper roll for bottom liner Ra1 with the double-sided tapes Tc, Tb, and Ta attached thereto are supplied to the standby positions of the mill roll stands 13, 11, and 17. Here, the worker sets the tips of the paper roll for top liner Rc1, the paper roll for medium paper Rb1, and the paper roll for bottom liner Ra1 on the splicers 13*a*, 11*a*, and 17*a*, respectively, so that the paper splicing is automatically performed when the remaining of the base paper roll that is being supplied is a small amount, or at the time of order switching of the base paper roll.

In this case, as shown in FIG. 7, at least the top liner C and the bottom liner A are supplied through predetermined guide rolls such that the inner surface of the paper roll for top liner Rc is on the upper side in the Z direction and the inner surface of the paper roll for bottom liner Ra is on the lower side in the Z direction.

In this case, in the mill roll stand 13, the paper roll for top liner replacement Rc1 is disposed on the upstream side in the supply direction X1 with respect to the paper roll for top liner Rc. In the mill roll stand 11, the paper roll for medium paper replacement Rb1 is disposed on the upstream side in the supply direction X1 with respect to the paper roll for medium paper Rb. In the mill roll stand 17, the paper roll for bottom liner replacement Ra1 is disposed on the downstream side in the supply direction X1 with respect to the paper roll for bottom liner Ra.

That is, in the mill roll stands 13 and 17, the paper roll for top liner Rc and the paper roll for bottom liner Ra, and the paper roll for top liner replacement Rc1 and the paper roll for bottom liner replacement Ra1 are disposed in opposite directions. The supply directions of the paper roll for top liner Rc and the paper roll for top liner replacement Rc1, and the supply directions of the paper roll for bottom liner Ra and the paper roll for bottom liner replacement Ra1 are opposite directions. With such disposition, the top liner C and the bottom liner A can be appropriately supplied, and the paper splicing can be performed appropriately.

[Operation and Effect of the Present Embodiment]

Paper roll handling equipment according to a first aspect includes the mill roll stand 11 that rotatably supports the paper roll for medium paper Rb and the paper roll for medium paper replacement Rb1, the mill roll stand 13 that rotatably supports the paper roll for top liner Rc and the paper roll for top liner replacement Rc1, and the mill roll stand 17 that rotatably supports the paper roll for bottom liner Ra and the paper roll for bottom liner replacement Ra1, in which the mill roll stand 13, the mill roll stand 11, and the mill roll stand 17 are disposed in order along the supply direction X1 of supplying the top liner C, the medium B, and the bottom liner A, and in the mill roll stand 13, the paper roll for top liner replacement Rc1 is disposed on the upstream side in the supply direction X1 with respect to the paper roll for top liner Rc, and in the mill roll stand 17, the paper roll for bottom liner replacement Ra1 is disposed on the downstream side in the supply direction X1 with respect to the paper roll for bottom liner Ra.

In the paper roll handling equipment according to the first aspect, the support positions of the paper roll for top liner Rc and the paper roll for top liner replacement Rc1 by the mill roll stand 13 and the support positions of the paper roll for bottom liner Ra and the paper roll for bottom liner replacement Ra1 by the mill roll stand 17 are reversed. In this way, since the top liner C and the bottom liner A can be appropriately supplied, the splice preparation in the paper splicing preparation work can be easily performed in advance, and the workability in the paper splicing preparation work can be improved.

In paper roll handling equipment according to a second aspect, the mill roll stand 13 can move the paper roll for top liner Rc and the paper roll for top liner replacement Rc1 toward the supply direction X1, and the mill roll stand 17 can move the paper roll for bottom liner Ra and the paper roll for bottom liner replacement Ra1 toward the direction opposite to the supply direction X1. In this way, the movement directions of the paper roll for top liner replacement Rc1 and the paper roll for bottom liner replacement Ra1 in the mill roll stands 13 and 17 are one direction and the opposite direction, so that the base paper roll replacement work can be simplified.

In paper roll handling equipment according to a third aspect, the mill roll stand 13 can send out the top liner C from the paper roll for top liner Rc toward the direction opposite to the supply direction X1, and the mill roll stand 17 can send out the bottom liner A from the paper roll for bottom liner Ra toward the supply direction X1. In this way, the inner surface and the outer surface of the top liner C and the bottom liner A can be appropriately supplied.

In paper roll handling equipment according to a fourth aspect, the rotation direction of the paper roll for top liner Rc by the mill roll stand 13 and the rotation direction of the paper roll for bottom liner Ra by the mill roll stand 17 are opposite directions. In this way, the inner surface and the outer surface of the top liner C and the bottom liner A can be appropriately supplied.

In paper roll handling equipment according to a fifth aspect, the rotation direction of the paper roll for top liner Rc and the rotation direction of the paper roll for top liner replacement Rc1 by the mill roll stand 13 are the same direction, and the rotation direction of the paper roll for bottom liner Ra and the rotation direction of the paper roll for bottom liner replacement Rat by the mill roll stand 17 are the same direction. In this way, the splicers 13*a* and 17*a* can be disposed at one location, so that the apparatus can be simplified.

In paper roll handling equipment according to a sixth aspect, in the mill roll stand 11, the paper roll for medium paper replacement Rb1 is disposed on the upstream side or the downstream side in the supply direction X1 with respect to the paper roll for medium paper Rb. In this way, the paper splicing preparation work in the mill roll stand 11 is performed on the side where the paper roll for medium paper replacement Rb1 is supported. Here, by setting the position of the paper roll for medium paper replacement Rb1 according to the disposition of peripheral equipment, it is possible to secure a work space for a worker.

In paper roll handling equipment according to a seventh aspect, on one side in the direction intersecting the supply direction X1, the carry-in line 31 for carrying in the paper roll for top liner replacement Rc1, the paper roll for medium paper replacement Rb1, and the paper roll for bottom liner replacement Ra1 to the mill roll stand 13, the mill roll stand 11, and the mill roll stand 17 is provided, and the carry-out line 32 for carrying out the used paper roll for top liner Rc, the used paper roll for medium paper Rb, and the used paper roll for bottom liner Ra from the mill roll stand 13, the mill roll stand 11, and the mill roll stand 17 is provided. In this way, the carry-in line 31 and the carry-out line 32 are collected on one side in the direction intersecting the supply direction X1, so that a disposition space can be effectively used.

In paper roll handling equipment according to an eighth aspect, the splice preparation unit 52 that provides the double-sided tapes (adhesive parts) Tc, Tb, and Tc to the tips of the outer surfaces of the top liner C, the medium B, and the bottom liner A in the paper roll for top liner replacement Rc1, the paper roll for medium paper replacement Rb1, and the paper roll for bottom liner replacement Ra1 is provided on the upstream side of the carry-in line 31. In this way, splice preparation work can be performed in advance, so that the paper splicing preparation work at the mill roll stands 11, 13, and 17 can be simplified, and labor-saving of a worker or automation of the paper splicing preparation work can be achieved.

A paper feed method according to a ninth aspect includes the mill roll stand 11 that rotatably supports the paper roll for medium paper Rb and the paper roll for medium paper replacement Rb1, the mill roll stand 13 that rotatably supports the paper roll for top liner Rc and the paper roll for top liner replacement Rc1, and the mill roll stand 17 that rotatably supports the paper roll for bottom liner Ra and the paper roll for bottom liner replacement Ra1, in which the mill roll stand 13, the mill roll stand 11, and the mill roll stand 17 are disposed in order along the supply direction X1 of supplying the top liner C, the medium B, and the bottom liner A, the method including: moving the paper roll for top liner replacement Rc1 along the supply direction X1 to supply it to a position adjacent to the paper roll for top liner Rc; and moving the paper roll for bottom liner replacement Ra1 along a direction opposite to the supply direction X1 to supply it to a position adjacent to the paper roll for bottom liner Ra. In this way, the paper splicing preparation work at each of the mill roll stands 13 and 17 can be performed on the side where the paper roll for top liner replacement Rc1 and the paper roll for bottom liner replacement Ra1 are supported, and the splice preparation in the paper splicing preparation work can be performed in advance. Therefore, the workability in the paper splicing preparation work can be improved.

In a paper feed method according to a tenth aspect, after completion of splice preparation of providing the double-sided tapes (adhesive parts) Tc, Tb, and Ta to the tips of the top liner C, the medium B, and the bottom liner A in the paper roll for top liner replacement Rc1, the paper roll for medium paper replacement Rb1, and the paper roll for bottom liner replacement Ra1, the paper roll for top liner replacement Rc1, the paper roll for medium paper replacement Rb1, and the paper roll for bottom liner replacement Rc1 are transported to the mill roll stand 13, the mill roll stand 11, and the mill roll stand 17. In this way, the splice preparation work can be performed in advance, the paper splicing preparation work at the mill roll stands 13, 11, and 17 can be simplified, and labor-saving of a worker or automation of the paper splicing preparation work can be achieved.

A corrugating machine (a cardboard sheet manufacturing apparatus) 10 according to an eleventh aspect includes the paper roll handling equipment 30, the single facer 15 that manufactures the single-faced cardboard sheet D by bonding the top liner C to the corrugated medium B, and the double facer 20 that manufactures the double-faced cardboard sheet E by bonding the bottom liner A to the medium B side of the single-faced cardboard sheet D. In this way, in the paper roll handling equipment 30, the paper splicing preparation work at each of the mill roll stands 13 and 17 can be performed on the side where the paper roll for top liner replacement Rc1 and the paper roll for bottom liner replacement Rat are supported, and the splice preparation in the paper splicing preparation work can be performed in advance. Therefore, the workability in the paper splicing preparation work can be improved.

In the embodiment described above, the mill roll stands 13 and 17 are configured to include the support bases 61 and 71, the upper support shafts 62 and 72, the lower support shafts 63 and 73, the upper support arms 64 and 74, the lower support arms 65 and 75, the carry-in conveyors 66 and 76, the carry-out conveyors 67 and 77, and the splicers 13*a* and 17*a*. However, there is no limitation to this configuration. Any configuration may be adopted as long as the base paper roll can be rotatably supported and the base paper roll can be moved in one direction. Further, the configuration of the paper roll handling equipment described in PTL 1 described above may be applied.

Further, in the embodiment described above, the carry-in line 31 and the carry-out line 32 are disposed on one side in the direction intersecting the supply direction X1. However, there is no limitation to this configuration. For example, the carry-in line 31 may be disposed on one side in the direction intersecting the supply direction X1, and the carry-out line 32 may be disposed on the other side.

REFERENCE SIGNS LIST

10: corrugating machine (cardboard sheet manufacturing apparatus)
11: mill roll stand
11*a*: splicer
12: preheater
13: mill roll stand
13*a*: splicer
14: preheater
15: single facer
16: bridge
17: mill roll stand
17*a*: splicer
18: preheater
19: glue machine
20: double facer
21: rotary shear
22: slitter scorer
23: cutoff
24: defective sheet rejecting device
25: stacker
30: paper roll handling equipment
31: carry-in line
32: carry-out line
33: paper roll carry-in line for top liner
34: paper roll carry-out line for top liner
35: paper roll carry-in line for medium paper
36: paper roll carry-out line for medium paper
37: paper roll carry-in line for bottom liner
38: paper roll carry-out line for bottom liner
41, 42, 43, 44, 45, 46: turntable
51: paper roll stock areae
52: splice preparation unit
53: remaining base paper roll collation unit
61, 71: support base
62, 72: upper support shaft
63, 73: lower support shaft
64, 74: upper support arm
65, 75: lower support arm
66, 76, 86: carry-in conveyor
67, 77, 87: carry-out conveyor
A: bottom liner
B: medium
C: top liner
D: single-faced cardboard sheet
E: continuous double-faced cardboard sheet
F: plate-shaped double-faced cardboard sheet
Rb: paper roll for medium paper
Rb1: paper roll for medium paper replacement
Ra: paper roll for bottom liner
Ra1: paper roll for bottom liner replacement
Rc: paper roll for top liner
Rc1: paper roll for top liner replacement
Ta, Tb, Tc: double-sided tape (adhesive part)
X1: supply direction

The invention claimed is:

1. Paper roll handling equipment comprising:

a first mill roll stand that rotatably supports a paper roll for top liner and a paper roll for top liner replacement;

a second mill roll stand that rotatably supports a paper roll for medium paper and a paper roll for medium paper replacement; and a third mill roll stand that rotatably supports a paper roll for bottom liner and a paper roll for bottom liner replacement, wherein the first mill roll stand, the second mill roll stand, and the third mill roll stand are disposed in order along a supply direction of supplying a top liner, a medium, and a bottom liner, in the first mill roll stand, the paper roll for top liner replacement is disposed on an upstream side in the supply direction with respect to the paper roll for top liner, and in the third mill roll stand, the paper roll for bottom liner replacement is disposed on a downstream side in the supply direction with respect to the paper roll for bottom liner, wherein the first mill roll stand is capable of moving the paper roll for top liner and the paper roll for top liner replacement toward the supply direction, and the third mill roll stand is capable of moving the paper roll for bottom liner and the paper roll for bottom liner replacement toward a direction opposite to the supply direction.

2. The paper roll handling equipment according to claim 1, wherein the first mill roll stand is capable of sending out the top liner from the paper roll for top liner toward a direction opposite to the supply direction, and the third mill roll stand is capable of sending out the bottom liner from the paper roll for bottom liner toward the supply direction.

3. The paper roll handling equipment according to claim 2, wherein a rotation direction of the paper roll for top liner by the first mill roll stand and a rotation direction of the paper roll for bottom liner by the third mill roll stand are opposite directions.

4. The paper roll handling equipment according to claim 1, wherein a rotation direction of the paper roll for top liner and a rotation direction of the paper roll for top liner replacement by the first mill roll stand are the same direction, and a rotation direction of the paper roll for bottom liner and a rotation direction of the paper roll for bottom liner replacement by the third mill roll stand are the same direction.

5. The paper roll handling equipment according to claim 1, wherein in the second mill roll stand, the paper roll for medium paper replacement is disposed on the upstream side or the downstream side in the supply direction with respect to the paper roll for medium paper.

6. The paper roll handling equipment according to claim 1, wherein on one side in a direction intersecting the supply direction, a carry-in line for carrying in the paper roll for top liner replacement, the paper roll for medium paper replacement, and the paper roll for bottom liner replacement to the first mill roll stand, the second mill roll stand, and the third mill roll stand is provided, and a carry-out line for carrying out the used paper roll for top liner, the used paper roll for medium paper, and the used paper roll for bottom liner from the first mill roll stand, the second mill roll stand, and the third mill roll stand is provided.

7. The paper roll handling equipment according to claim 6, wherein a splice preparation unit that provides adhesive parts to tips of outer surfaces of the top liner, the medium, and the bottom liner in the paper roll for top liner replacement, the paper roll for medium paper replacement, and the paper roll for bottom liner replacement is provided on an upstream side of the carry-in line.

8. A cardboard sheet manufacturing apparatus comprising:

the paper roll handling equipment according to claim 1;

a single facer that manufactures a single-faced cardboard sheet by bonding the top liner to the corrugated medium; and a double facer that manufactures a cardboard sheet by bonding the bottom liner to the medium side of the single-faced cardboard sheet.

9. A paper roll handling method that includes a first mill roll stand that rotatably supports a paper roll for top liner and a paper roll for top liner replacement, a second mill roll stand that rotatably supports a paper roll for medium paper and a paper roll for medium paper replacement, and a third mill roll stand that rotatably supports a paper roll for bottom liner and a paper roll for bottom liner replacement, in which the first mill roll stand, the second mill roll stand, and the third mill roll stand are disposed in order along a supply direction of supplying a top liner, a medium, and a bottom liner, the method comprising:

moving the paper roll for top liner replacement along the supply direction to supply the paper roll for top liner replacement to a position adjacent to the paper roll for top liner; and moving the paper roll for bottom liner replacement along a direction opposite to the supply direction to supply the paper roll for bottom liner replacement to a position adjacent to the paper roll for bottom liner, wherein the first mill roll stand is capable of moving the paper roll for top liner and the paper roll for top liner replacement toward the supply direction, and the third mill roll stand is capable of moving the paper roll for bottom liner and the paper roll for bottom liner replacement toward a direction opposite to the supply direction.

10. The paper roll handling method according to claim 9, wherein after completion of splice preparation of providing adhesive parts to tips of the top liner, the medium, and the bottom liner in the paper roll for top liner replacement, the paper roll for medium paper replacement, and the paper roll for bottom liner replacement, the paper roll for top liner replacement, the paper roll for medium paper replacement, and the paper roll for bottom liner replacement are transported to the first mill roll stand, the second mill roll stand, and the third mill roll stand.

* * * * *